US007709436B2

(12) United States Patent
Theiler et al.

(10) Patent No.: US 7,709,436 B2
(45) Date of Patent: May 4, 2010

(54) LOW CARBON FOOTPRINT COMPOSITIONS FOR USE IN LAUNDRY APPLICATIONS

(75) Inventors: Richard F. Theiler, Scottsdale, AZ (US); Daniel L. Carter, Anthem, AZ (US); Pamela Lam, Scottsdale, AZ (US); Lizette M. Bonvin, Scottsdale, AZ (US); Frank Meier, Scottsdale, AZ (US)

(73) Assignee: The Dial Corporation, Scottsdale, AZ (US)

( * ) Notice: Subject to any disclaimer, the term of this patent is extended or adjusted under 35 U.S.C. 154(b) by 0 days.

(21) Appl. No.: 12/179,504

(22) Filed: Jul. 24, 2008

(65) Prior Publication Data

US 2009/0054294 A1 Feb. 26, 2009

Related U.S. Application Data

(63) Continuation-in-part of application No. 12/151,597, filed on May 8, 2008.

(60) Provisional application No. 60/951,556, filed on Jul. 24, 2007, provisional application No. 60/928,362, filed on May 9, 2007.

(51) Int. Cl.

| | |
|---|---|
| ***C11D 1/12*** | (2006.01) |
| ***C11D 3/22*** | (2006.01) |
| ***C11D 3/386*** | (2006.01) |
| ***C11D 7/08*** | (2006.01) |
| ***C11D 7/10*** | (2006.01) |

(52) U.S. Cl. ..... 510/320; 510/101; 510/331; 510/342; 510/351; 510/356; 510/357; 510/392; 510/426; 510/437; 510/474; 510/492

(58) Field of Classification Search ..... 510/101, 510/320, 331, 342, 351, 356, 357, 392, 426, 510/437, 474, 492

See application file for complete search history.

(56) References Cited

U.S. PATENT DOCUMENTS

| | | | | |
|---|---|---|---|---|
| 5,003,057 | A | 3/1991 | McCurry et al. | |
| 5,030,378 | A | 7/1991 | Venegas | |
| 5,338,491 | A * | 8/1994 | Connor et al. | 510/299 |
| 5,677,272 | A | 10/1997 | Ghosh et al. | |
| 5,679,630 | A | 10/1997 | Baeck et al. | |
| 5,703,027 | A | 12/1997 | Caravajal et al. | |
| 5,703,034 | A | 12/1997 | Offshack et al. | |
| 5,705,464 | A | 1/1998 | Scheper et al. | |
| 5,707,950 | A | 1/1998 | Kasturi et al. | |
| 5,707,951 | A | 1/1998 | Masschelein et al. | |
| 5,710,115 | A | 1/1998 | Patel et al. | |
| 5,710,116 | A | 1/1998 | Miracle et al. | |

(Continued)

*Primary Examiner*—Brian P Mruk
(74) *Attorney, Agent, or Firm*—Snell & Wilmer L.L.P.

(57) ABSTRACT

Liquid laundry detergent compositions are provided that show remarkable performance even though they utilize only eco-friendly ingredients and have a sustainability index of greater than 3. Some embodiments include a liquid laundry detergent composition comprising alkyl polyglycoside (APG) with fatty alcohol sulfate, at least two detersive enzymes, an enzyme stabilization system (e.g. borate and/or citrate and/or calcium salts), d-limonene or other natural essence, water and adjuvant. In another exemplary embodiment, APG is combined with fatty acid soaps, at least two detersive enzymes, an enzyme stabilization system (e.g. borate and/or citrate and/or calcium salts), d-limonene or other natural essence, water and adjuvant. Such compositions show remarkable performance, good viscosity, physical storage stability, enzyme stability, and have a sustainability index of greater than 3.

11 Claims, 6 Drawing Sheets

U.S. PATENT DOCUMENTS

| | | | |
|---|---|---|---|
| 5,710,118 | A | 1/1998 | Busch et al. |
| 5,710,119 | A | 1/1998 | Busch et al. |
| 5,721,202 | A | 2/1998 | Waite et al. |
| 5,763,257 | A | 6/1998 | Bott et al. |
| 5,972,682 | A | 10/1999 | Bott et al. |
| 6,060,441 | A | 5/2000 | Hessel et al. |
| 6,136,778 | A | 10/2000 | Kamiya |
| 6,333,301 | B1 | 12/2001 | Kamiya |
| 6,407,051 | B1 | 6/2002 | Smith et al. |
| 6,465,235 | B1 | 10/2002 | Bott et al. |
| 7,030,077 | B2 | 4/2006 | Beers et al. |
| 7,033,984 | B2 | 4/2006 | Hafkamp et al. |
| 2002/0137658 | A1 | 9/2002 | Faber |
| 2003/0082131 | A1 | 5/2003 | Drapier et al. |
| 2006/2005628 | | 9/2006 | Deinhammer et al. |
| 2007/0207940 | A1* | 9/2007 | Fenyvesi et al. ..... 510/276 |

* cited by examiner

LOW CARBON FOOTPRINT COMPOSITIONS FOR USE IN LAUNDRY APPLICATIONS

CROSS-REFERENCE TO RELATED APPLICATIONS

This application claims the benefit of and priority to U.S. Provisional Patent Application Ser. No. 60/951,556, entitled "Low Carbon Footprint Compositions with Enzymes and Natural Essences and High Performance and Biodegradability", filed Jul. 24, 2007, and is a continuation in part of U.S. patent application Ser. No. 12/151,597, entitled "Eco-friendly Laundry Detergent Compositions Comprising Natural Essence", filed May 8, 2008, which claims the benefit of and priority to U.S. Provisional Patent Application Ser. No. 60/928,362, entitled "Eco-friendly Laundry Detergent Compositions Comprising Surfactants, Builders and Natural Essence", filed May 9, 2007, all of which are incorporated by reference herein.

FIELD OF INVENTION

The present invention relates to various consumer, commercial and industrial products, including detergent compositions, comprising biodegradable and eco-friendly ingredients that exhibit exceptional performance compared to traditional detergent formulations that use less friendly surfactant and builder ingredients while maintaining a low "carbon footprint," maximizing performance and biodegradability and using natural ingredients. In particular, for example, this invention relates to ecologically responsible liquid laundry detergent compositions that utilize unique surfactant-enzyme-builder combinations in conjunction with natural essences.

BACKGROUND

Many consumer, commercial and industrial products, including liquid laundry detergents have been known in the art for decades. For example, in the context of laundry detergents, many are comprised of blends of synthetic anionic, nonionic and conditioning cationic surfactants, along with any number of additional ingredients such as builders, dispersants, soil-release polymers, detersive enzymes and bleaching agents to improve cleaning performance and to arrive at consumer acceptable performance at a reasonable cost.

The prior art is nearly void of compositions that claim suitable performance through the use of eco-friendly ingredients. Heretofore there have simply been no suitable "across-the-board" substitutions of unfriendly ingredients to more ecologically friendly ingredients in a laundry detergent composition to yield compositions that can still provide consumer acceptable performance at reasonable cost to the manufacturer. It is simple (as shown in the art) to make sensible substitutions or reductions of one or a few ingredients, (for example, ability to reduce builder or surfactant by increasing enzyme levels), however, a wholesale replacement of all ingredients in a composition with eco-friendly ingredients typically results in a serious reduction in performance.

One way to increase performance in a laundry detergent and reduce pollution is to replace high surfactant and builder levels with high enzyme levels, for example, through the replacement of surfactants, builders, polymers, and bleaches in detergent compositions with enzymes.

However, it is problematic to apply this strategy for the replacement of all suspect ingredients in a composition, as the required multiple types of enzymes need to be combined and stabilized in ways that heretofore have not been explored and additional ingredients beyond the enzymes will be needed to make up for lost performance. For example, when common surfactants are replaced with eco-friendly surfactants, and the highly alkaline builder/chelant systems are eliminated, then simply increasing enzyme level is not enough, and the technology that is truly missing from the art is how to combine the right combinations of different enzymes at the right levels, using the right enzyme stabilizers with the right eco-friendly co-ingredients to boost the performance back to consumer acceptable levels.

Moreover, until the present invention, laundry detergents (and other products) generally sacrificed performance and biodegradability and/or contained minimal natural ingredients, as well as had higher carbon footprints.

It has now been found that by lowering the surfactant levels and replacing them with other components, a lower carbon footprint can be realized. Additionally, surprisingly the combination of certain biodegradable anionic materials with alkyl polyglycoside surfactants and enzyme mixtures, together with "natural essences", can lead to stable liquid laundry detergents that are comprised entirely or nearly entirely of eco-friendly ingredients, yet still have performance at par or even superior to past traditional liquids that use much less friendly constituents. Importantly, the present invention results in a low "carbon footprint" and maximizes performance and biodegradability, and uses natural ingredients.

SUMMARY

Our summary of the invention is intended to introduce the reader to general aspects of the detergent compositions and not intended to be a complete description. Particular aspects of the present invention are described in other sections below.

In summary, the present invention is described herein in the context of eco-friendly liquid laundry detergent compositions which maintain a low "carbon footprint" and maximize performance, biodegradability and the use of natural ingredients. That said, one skilled in the art will appreciate that the methodology and inventive concepts described herein may apply to numerous consumer and commercial products such as personal care products, household and commercial cleaners and the like.

A laundry detergent composition in accordance with the present invention comprises biodegradable and naturally derived anionic and nonionic materials, enzymes, enzyme stabilizers and water, with "natural essences" (essential oils or other natural extracts, infusions and the like) with a lower carbon footprint, and exhibits high performance.

In accordance with an exemplary embodiment of the present invention, liquid laundry detergent compositions are provided that show remarkable performance even though they utilize only eco-friendly ingredients and have a sustainability index of greater than 3. More specifically, an exemplary embodiment of the present invention is a liquid laundry detergent composition comprising alkyl polyglycoside (APG) with fatty alcohol sulfate, at least two detersive enzymes, an enzyme stabilization system (e.g. borate and/or citrate and/or calcium salts), d-limonene or other natural essence, water and adjuvant. In another exemplary embodiment, APG is combined with fatty acid soaps, at least two detersive enzymes, an enzyme stabilization system (e.g. borate and/or citrate and/or calcium salts), d-limonene or other natural essence, water and adjuvant. Such compositions show remarkable performance, good viscosity, physical storage stability, enzyme stability, and have a sustainability index of greater than 3. In some embodiments, the compositions of the present invention use only biodegradable and eco-friendly surfactants and natural essences.

BRIEF DESCRIPTION OF THE DRAWINGS

Additional embodiments of the invention will become evident upon reviewing the non-limiting embodiments described in the specification and the claims, in conjunction with the accompanying figures, wherein:

DETAILED DESCRIPTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and relative amounts of components described without departing from the scope of the invention as set forth in the appended claims. Additionally, though described herein largely in the context of a laundry detergent, those skilled in the art will appreciate that the inventive concepts described herein may likewise apply to other products as well.

Preliminarily, one skilled in the art will appreciate that four factors are commonly considered with respect to the efficacy and environmental impact of a particular product, namely, the use of natural ingredients, biodegradable ingredients, the carbon footprint of the ingredients and the product itself, and the performance or efficacy of the product. However, heretofore, compositions considering the foregoing tended to sacrifice at least one of the foregoing factors when trying to enhance another. The present invention minimizes or eliminates such sacrifice, realizing the highest benefits of each factor.

Figure 1:
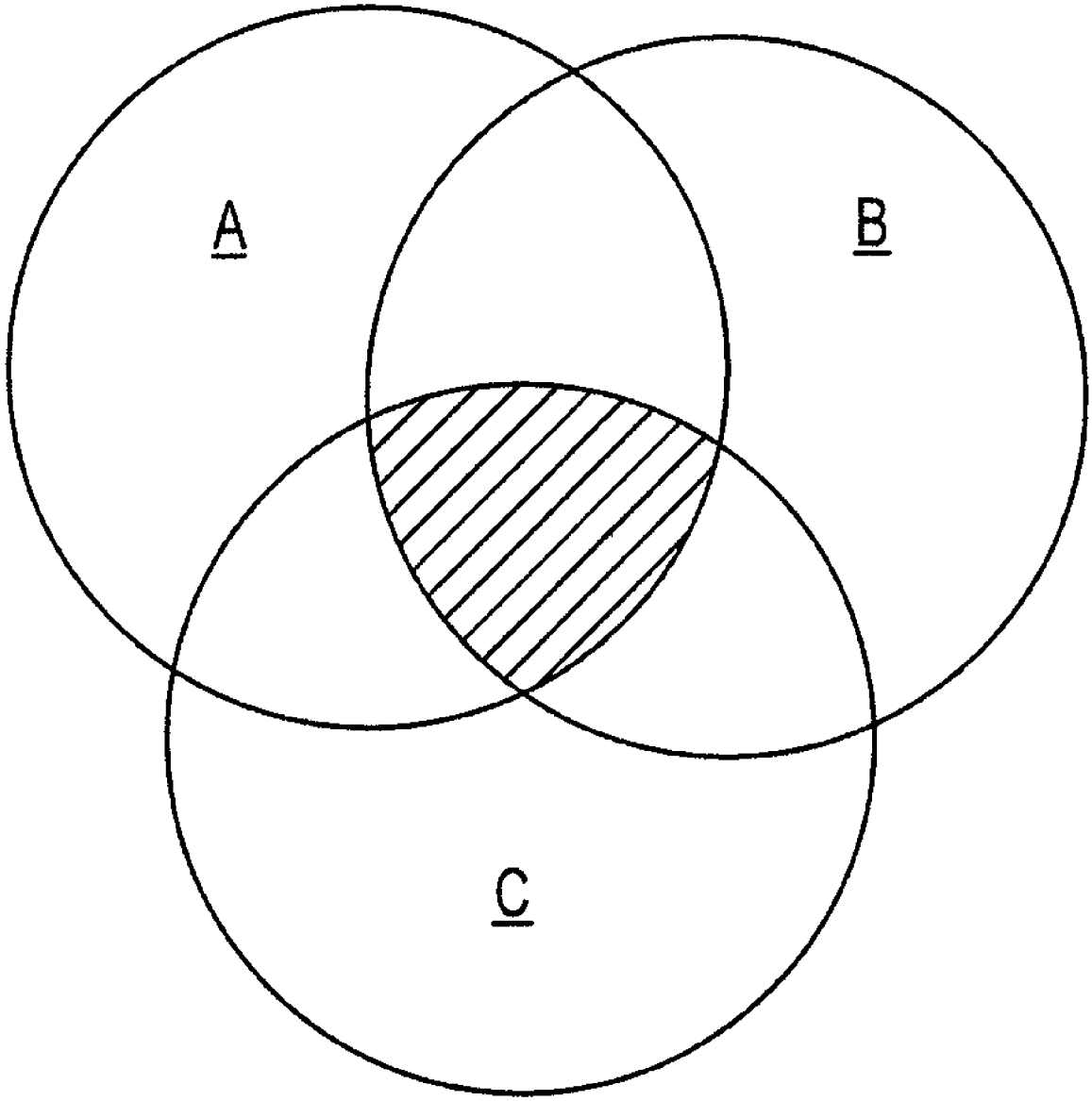
FIG. 1 is a diagram illustrating the consideration of natural ingredients (A), biodegradability (B), and $CO_2$ or carbon footprint (C) and their interaction in accordance with the present invention.
Figure 2:
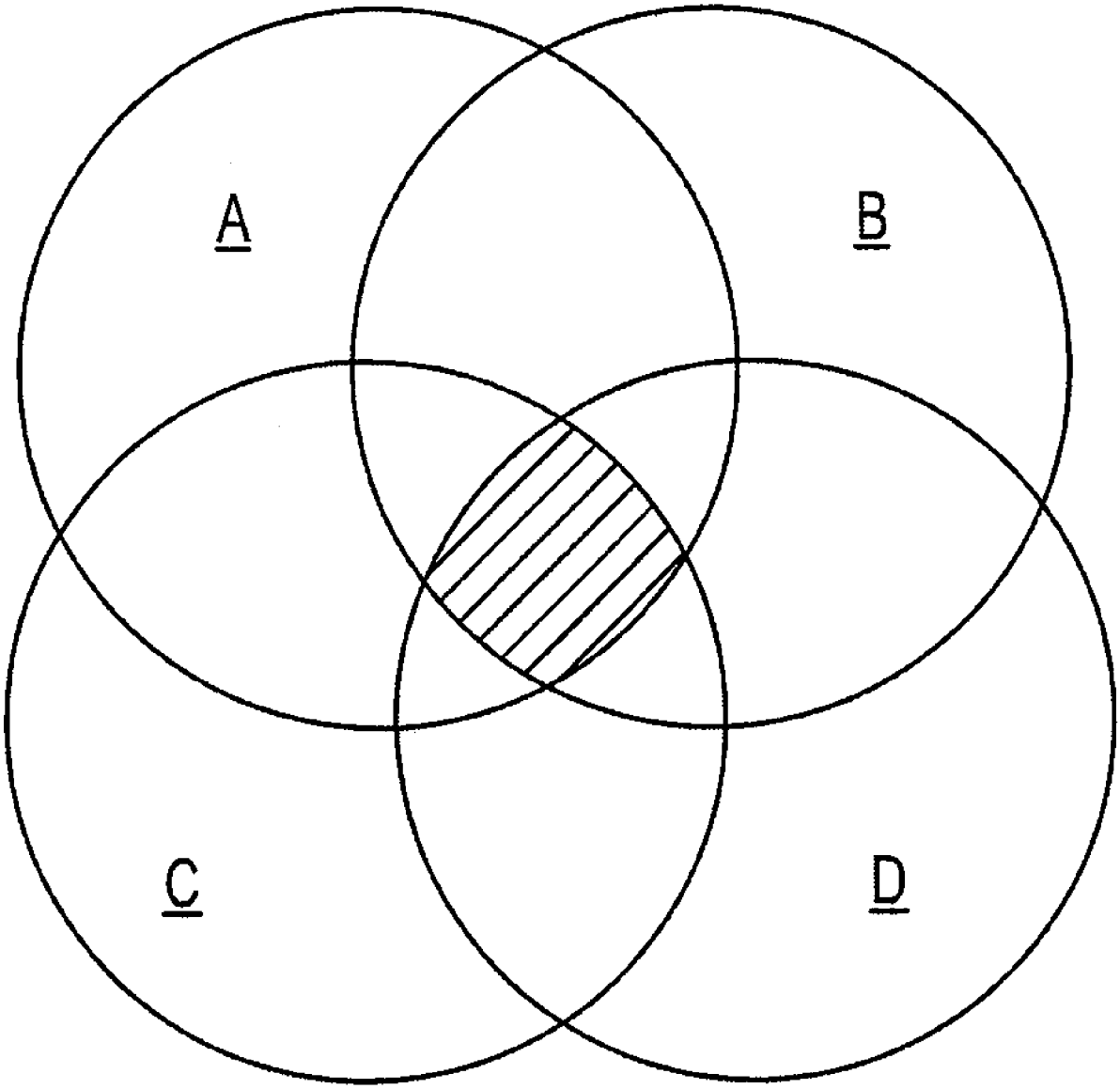
FIG. 2 is a diagram illustrating the consideration of natural ingredients (A), biodegradability (B), and $CO_2$ or carbon footprint (C), and performance (D) and their interaction in accordance with the present invention.

For example, with reference to FIG. 1, a diagram consisting of natural ingredient considerations (A), biodegradability considerations (B), and $CO_2$ or carbon footprint considerations (C). In prior art application, to minimize carbon footprint (C), one did not use as much natural ingredient (A) or lost biodegradability attributes (C). However, embodiments in accordance with the present invention have surprisingly shown that careful selection of components included in the product maximize the use of natural ingredients (A), maximize the biodegradability (B) of the product and minimize the carbon footprint (C) of the product. The shaded area of FIG. 1 illustrates this aspect. Further still, as represented in FIG. 2, the present invention also can exhibit increased performance (D), while still maximizing the use of natural ingredients (A), maximizing the biodegradability (B) of the product and minimizing the carbon footprint (C) of the product. The same is illustrated by the shaded region found in FIG. 2.

In various embodiments, the present invention relates to a composition for laundering fabrics that exhibit good performance such as stain removal and whiteness retention even though the compositions are comprised entirely of ecologically responsible ingredients, additionally resulting in a sustainability index of less than about 3.

Broadly, a "carbon footprint" is a measure of the impact human activities have on the environment in terms of the amount of greenhouse gases produced, measured in units of carbon dioxide ($CO_2$). In general, carbon footprint refers to a measure of the amount of $CO_2$ emitted through the combustion of non-renewable fossil fuels. For example, in the case of an organization, business or enterprise, as part of their everyday operations; in the case of an individual or household, as part of their daily lives; or a product or commodity in reaching market. In materials, a carbon footprint is essentially a measure of embodied energy, the result of life cycle analysis. This is related to the amount of natural resources consumed, increasingly used or referred to as a measure of environmental impact. Carbon dioxide is recognized as a greenhouse gas, of which increasing levels in the atmosphere are linked to global warming and climate change.

There are many versions of calculators available for determining a carbon footprint, however, by determining a carbon footprint as a constant, one can compare compositions on a standard basis and developed a carbon footprint value correlating to comparable life cycles of such compositions. In various aspects of the present invention, a carbon footprint of a laundry composition is determined by total organic carbon (TOC) method. Alternatively, in various aspects of the present invention, a carbon footprint of a laundry composition is determined by a calculation of carbon content of each of the components in the composition. Using either of the describe calculations of carbon content, the sample size or dosage should remain constant among the different laundry compositions analyzed.

For example, in the context of laundry detergents, various known formulations have measurable carbon footprints. As illustrated in Table 1, carbon content is determined for the formulation of laundry composition of the present invention (new formula) and a variety of known laundry compositions.

TABLE 1

Comparison of Carbon Content of Laundry Detergents

| | $CO_2$ Emissions | | |
|---|---|---|---|
| | Dosage (g) (medium load) | grams $CO_2$/dose | Percent $CO_2$ |
| New Formula 1 | 47 | 8.2 | 17.45% |
| New Formula 2 | 47 | 11 | 23.40% |
| Retail 1 | 47 | 14.85 | 31.60% |
| Retail 2 | 47 | 15.04 | 32.00% |
| Retail 3 | 47 | 43.24 | 92.00% |
| Retail 4 | 47 | 14.85 | 31.60% |
| Retail 5 | 47 | 15.60 | 33.19% |
| Retail 6 | 47 | 15.23 | 32.40% |
| Retail 7 | 47 | 16.17 | 34.40% |
| Retail 8 | 47 | 19.36 | 41.19% |
| Retail 9 | 47 | 29.33 | 62.40% |
| Retail 10 | 47 | 48.69 | 103.60% |
| Retail 11 | 47 | 56.96 | 121.2% |
| Retail 12 | 47 | 43.24 | 92.00% |

TABLE 1-continued

| Comparison of Carbon Content of Laundry Detergents | | | |
|---|---|---|---|
| | $CO_2$ Emissions | | |
| | Dosage (g) (medium load) | grams $CO_2$/dose | Percent $CO_2$ |
| Retail 13 | 31 | 26.91 | 86.81% |
| Retail 14 | 94 | 25.57 | 27.20% |

The examples of Table 1 illustrate exemplary carbon footprint by assuming that every component of the composition (all of the carbon) will break down to form $CO_2$. Since $CO_2$ is heavier than carbon, the percentage of $CO_2$ generated by a composition can be greater than 100% of the original weight of the composition. The dosage size is typically 47 grams which is on average the amount of laundry composition used in a medium size load of laundry. In this comparison two of the sample had dosage sizes outside of the 47 gram target but these where within the dosage to a medium size load for those compositions. The different dosage sizes where considered and factored during the determination of a carbon footprint for each of the compositions. In some embodiments, it can be assumed the other materials, such as for example, preservatives, dyes, and the like, would not be significant contributors to $CO_2$ production. In various aspects of the present invention, the percent $CO_2$ produced by a composition is the percent carbon footprint of the composition.

The new formulas provide compositions that have a low carbon footprint while maintain cleaning efficiency. As shown in Table 1 New Formula 1 and New Formula 2 have less carbon dioxide generated then that any of the other listed laundry compositions. Additionally, notwithstanding reductions in surfactant and carbon footprint, compositions in accordance with various embodiments of the present invention, exhibit surprising performance attributes. In some cases, compositions in accordance with the present invention exhibit performance near or better than comparable compositions with high carbon footprints, low biodegradability, and/or low natural ingredient levels. Indeed, any differences in performance where compositions of the present invention are lower are often imperceptible or not significant to consumers.

More specifically, Table 2 is a comparison of cleaning efficiency of selected laundry compositions on a variety of common stains. The scoring on each of the common stains is from 0 to 100. The New Formula of the present invention is essentially equivalent in cleaning efficiency to the other laundry compositions listed in Table 2. Table 4 is a summary by stain types with a statistical variance and total cleaning efficiency of each of the laundry compositions studied in Table 2. The total cleaning efficiency of the all the laundry compositions studied are equivalent with in the statistical error of the study. As discussed herein, this is a surprising and unexpected result.

The following conditions were used in various wash comparison of the various compositions:

1. Warm Wash Conditions
   - Warm Water (96-100 F) Wash
   - Single Cold Water (60-63 F) Rinse
   - Medium Fill and Normal Cycle on Kenmore Elite top-loading machine
   - Water Hardness=150 ppm
   - Ballast=5.5 lbs pillowcases
2. Cold Wash Conditions
   - Cold Water (60-63 F) Wash
   - Single Cold Water (60-63 F) Rinse
   - Medium Fill and Normal Cycle on Kenmore Elite top-loading machine
   - Water Hardness=150 ppm
   - Ballast=5.5 lbs pillowcases
3. Pre-treat
   - Measure dose in cup
   - From dose, take 1 gram detergent and place directly on each stain
   - Let stains sit for 5 minutes
   - Start washer (conditions are stated in #1 or 2 above)
   - Add remaining detergent dose to washer
   - After 5 minutes, add pretreated stains to the washer
   - Close lid and let washer run until completed.
4. Through the Wash
   - Start washer (conditions are stated in #1 and 2 above)
   - Add detergent
   - Let washer fill
   - Add cloth
   - Close lid and let washer run until completed

TABLE 2

| Comparison of cleaning efficiency of selected laundry compositions | | | | | | |
|---|---|---|---|---|---|---|
| | New Formula 1 | Retail 2 | Retail 3 | Retail 13 | Retail 5 | Retail 14 |
| Animal Blood | 86.74 | 87.09 | 88.15 | 87.76 | 87.29 | 88.40 |
| Black Todd Clay | 88.04 | 88.98 | 89.21 | 89.24 | 88.55 | 89.01 |
| Chocolate Ice Cream | 84.14 | 84.47 | 87.34 | 85.52 | 84.19 | 85.19 |
| Grass | 81.50 | 82.46 | 87.74 | 83.30 | 81.80 | 84.51 |
| Cocoa | 87.77 | 88.02 | 88.89 | 88.51 | 87.99 | 88.77 |
| Make up | 79.66 | 81.08 | 82.20 | 81.72 | 81.09 | 81.57 |
| Lipstick | 49.42 | 49.88 | 53.06 | 50.08 | 49.63 | 49.55 |
| Ground in Dirt | 77.56 | 79.55 | 80.19 | 78.58 | 79.42 | 79.67 |
| Coffee | 82.20 | 82.97 | 83.93 | 82.49 | 82.87 | 82.97 |
| Tea | 82.20 | 82.34 | 83.23 | 81.92 | 81.83 | 81.94 |
| Blueberry | 76.35 | 77.59 | 77.23 | 76.55 | 77.88 | 76.74 |
| Wine | 80.56 | 81.07 | 82.19 | 80.76 | 81.03 | 80.74 |
| Tomato Sauce | 88.42 | 88.79 | 88.59 | 88.88 | 88.66 | 88.71 |
| Taco Grease | 56.92 | 57.20 | 58.57 | 58.17 | 57.37 | 57.49 |
| Canola Oil | 62.56 | 61.80 | 63.53 | 63.49 | 62.99 | 63.18 |
| Bacon Grease | 60.03 | 59.08 | 61.21 | 59.44 | 58.87 | 58.97 |
| Olive Oil | 62.29 | 62.18 | 63.03 | 63.19 | 63.09 | 63.03 |
| Carrot Juice | 88.16 | 88.74 | 90.96 | 89.13 | 88.75 | 90.55 |
| Blueberry Juice | 55.52 | 63.42 | 61.21 | 56.55 | 59.69 | 58.29 |
| Grass | 89.22 | 87.48 | 89.27 | 89.15 | 89.63 | 89.56 |
| Spinach | 79.91 | 81.07 | 85.93 | 80.08 | 80.41 | 81.18 |
| Ketchup | 89.34 | 89.52 | 90.46 | 90.06 | 89.67 | 90.31 |
| Spaghetti Sauce | 89.13 | 89.11 | 89.92 | 89.10 | 89.41 | 89.62 |
| Choc Mousse(Water) | 72.73 | 75.65 | 84.08 | 74.54 | 74.44 | 75.94 |
| Curry Sauce | 86.85 | 86.68 | 88.18 | 86.71 | 86.69 | 86.99 |
| Balsamic Vinaigrette | 81.18 | 81.33 | 83.25 | 82.42 | 81.04 | 83.18 |
| Cherry Juice | 86.16 | 84.82 | 85.87 | 84.05 | 84.26 | 84.22 |
| Red Wine(Bordeaux) | 78.47 | 77.94 | 79.42 | 77.11 | 76.24 | 76.85 |
| Tea | 84.28 | 84.26 | 85.65 | 84.06 | 83.31 | 85.20 |
| Cocoa | 73.14 | 73.74 | 77.21 | 75.03 | 73.59 | 76.69 |
| Choc Ice Cream | 80.62 | 79.70 | 85.44 | 79.81 | 78.66 | 80.46 |
| Mousse au Choc | 74.46 | 81.11 | 80.91 | 84.82 | 79.85 | 80.63 |

TABLE 3

| | Comparison of cleaning efficiency by stain type of selected laundry compositions | | | | | |
|---|---|---|---|---|---|---|
| | New Formula 1 | Retail 2 | Retail 3 | Retail 13 | Retail 5 | Retail 14 |
| Enzyme | 84.15 | 83.48 | 87.03 | 83.89 | 84.26 | 85.47 |
| | 5.3 | 5.0 | 3.8 | 5.1 | 5.5 | 4.7 |
| Greasy/Oily | 67.10 | 66.97 | 68.54 | 67.65 | 67.29 | 67.45 |
| | 15.8 | 15.8 | 15.2 | 15.6 | 15.9 | 16.0 |
| Particulate | 81.00 | 81.64 | 84.13 | 82.09 | 81.64 | 82.87 |
| | 6.0 | 5.5 | 5.0 | 5.5 | 5.8 | 4.9 |
| Bleachable | 80.78 | 81.64 | 82.15 | 80.67 | 80.96 | 81.07 |
| | 9.8 | 7.6 | 8.4 | 9.6 | 8.6 | 9.2 |
| All Stains | 78.26 | 78.43 | 80.46 | 78.58 | 78.54 | 79.22 |
| | 7.60 | 7.69 | 8.20 | 7.41 | 7.63 | 8.05 |

Figure 3:
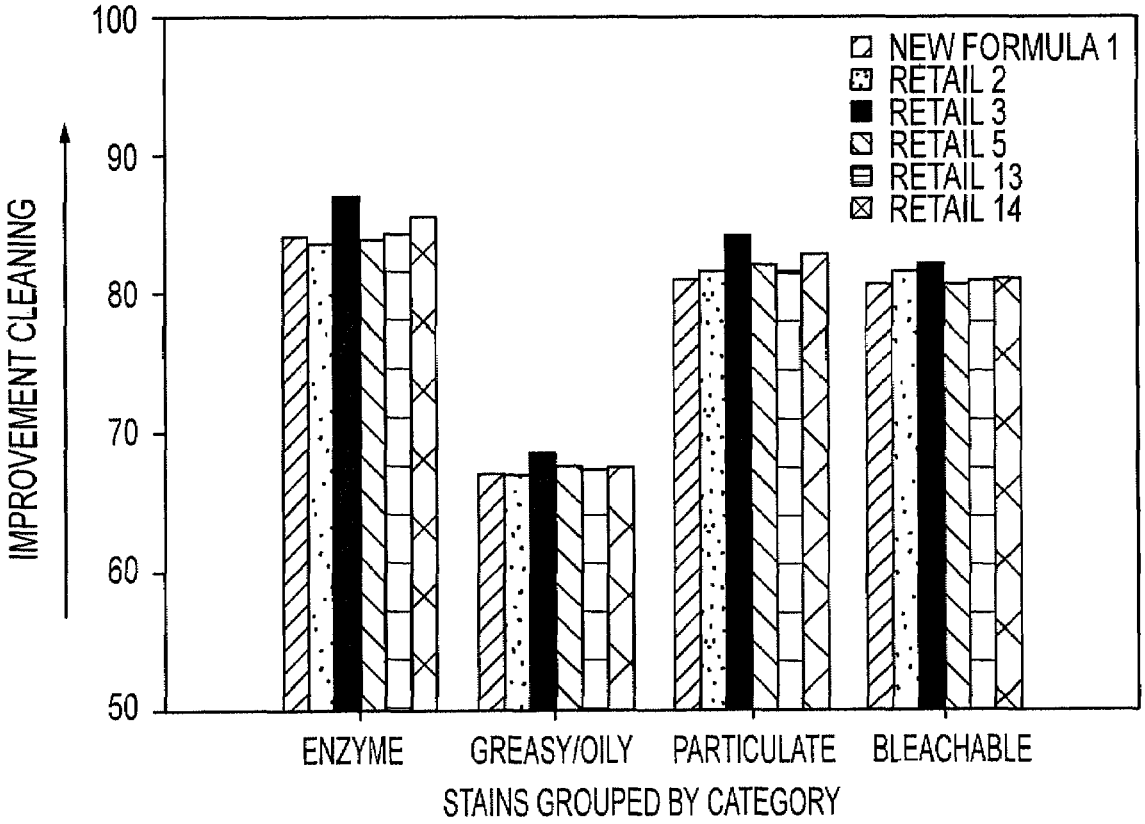
FIG. 3 is a chart illustrating a comparison of a "through the wash" performance between a sampling of laundry detergent compositions in accordance with the present invention.

For example, a comparison of a "through the wash" performance between a sampling of laundry detergent compositions of Table 1 is illustrated in FIG. 3, which is a laundry detergent performance evaluation by stain category. The conditions for this comparison are a warm wash, no pretreatment and through the wash. Although New Formula 1 has a lower carbon content then all other compositions in Table 1, New Formula 1 has cleaning efficiencies in all tested categories that are similar to those of the sampling of laundry detergent compositions illustrated in FIG. 3. This is a surprising result, since the art would appear to illustrate that a lower carbon content in the laundry composition typically lowers the cleaning efficiency of that laundry composition, as discussed herein.

Figure 4:
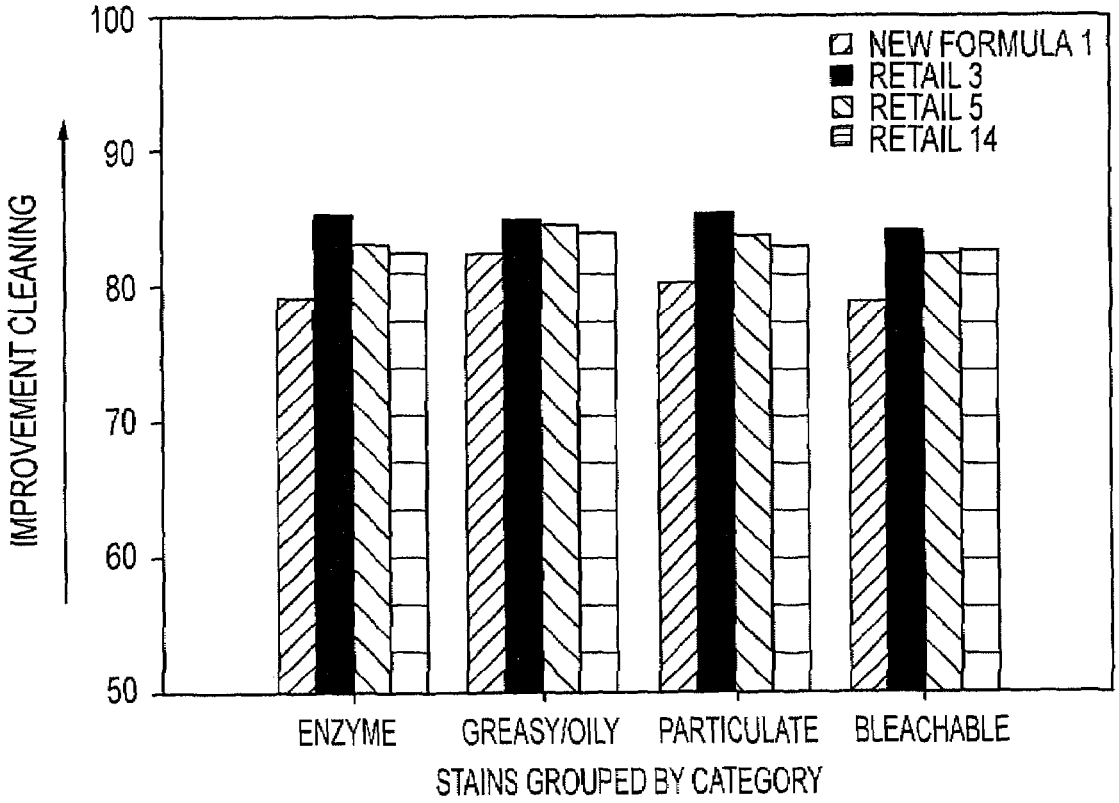
FIG. 4 is a chart illustrating a comparison of a "pre-treat" performance between a sampling of laundry detergent compositions in accordance with the present invention.

In another example, a comparison of a "pre-treat" performance between another sampling of laundry detergent compositions of Table 1 is illustrated in FIG. 4, which is a laundry detergent performance evaluation by stain category. The conditions for this comparison are a warm wash, and pretreatment for five minutes. Although New Formula 1 has a lower carbon content then all other compositions in Table 1, New Formula 1 has cleaning efficiencies in all tested categories that are similar to those of the sampling of laundry detergent compositions illustrated in FIG. 4. Again, this is a surprising result, since the art would appear to illustrate that lower the carbon content in the laundry composition typically lowers the cleaning efficiency of that laundry composition, as discussed herein.

The liquid laundry detergent compositions of the present invention include; a nonionic surfactant, preferably the vegetable derived alkyl polyglycoside surfactant; anionic surfactant components, preferably fatty acid soaps, and/or alkyl sulfates, and/or alkyl ether sulfates; at least two detersive enzymes, and a "natural essence such as an essential oil, natural tree, plant, fruit, nut or seed extract or infusion, or synthetic organic substance, to boost performance and in many instances, also provide fragrance. In accordance with yet another exemplary embodiment, a liquid laundry detergent composition is provided with all of these components along with citrate and/or borate and/or calcium salt enzyme stabilizers, builders, and chelants or polymeric soil dispersants and optional active oxygen-materials, and additional adjuvant The carbon footprint and cleaning efficiency described herein can be used to calculate a sustainability index (SI). The SI is a calculation to determine the relationship between lowering the carbon footprint and acceptable cleaning efficiency. View alternatively, SI can be used to select components to formulate a composition that meets a SI criteria. The SI can be described in a formula:

$$SI = \frac{(\%\ \text{cleaning efficiency})}{(\%\ \text{total carbon footprint})}$$

Figure 5:
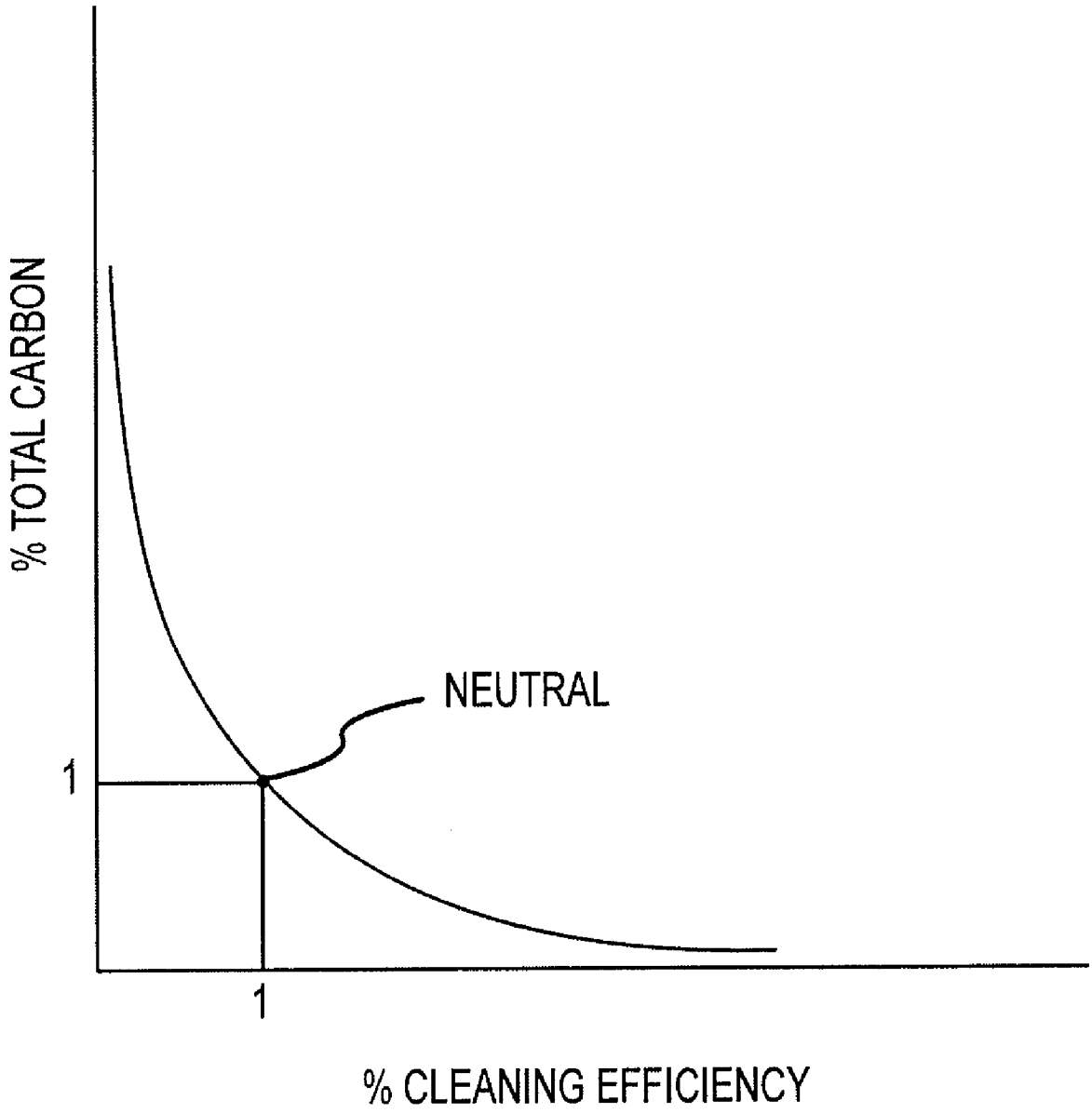
FIG. 5 is a graphical illustration of sustainability index in accordance with the present invention.

The % total carbon footprint is described herein and is calculated for various laundry compositions in Table 1. The % cleaning efficiency uses the total cleaning efficiency as described in Table 4. The % cleaning efficiency is the cleaning efficiency described in Table 4 multiplied by 0.01 to convert the number into a percentage. The SI is thus a unit-less number. FIG. 5 shows a graphical relationship between increases in % total carbon v. % cleaning efficiency. When SI is 1, this is considered neutral. When SI is less than 1, the composition is considered less sustainable. When SI is greater than 1 the composition is somewhat sustainable. When SI is greater than 3, the product is considered sustainable. The target for the compositions of the present invention is to have a SI greater than 3.

Various embodiments of the present invention include laundry cleaning composition comprising at least one anionic surfactant, at least one enzyme, at least inorganic salt, at least one acid, and a balance of water, wherein the laundry cleaning composition has a sustainability index (SI) of at least 3. Any or all of the components of the laundry cleaning composition can be biodegradable. At least one nonionic surfactant of the laundry composition can be an alkylpolyglucoside. The composition can comprise a fabric softening component. The composition can comprise naturally derived fragrance component. In addition the composition can comprise at least one of an amphoteric surfactant and a nonionic surfactant. Various embodiments of the present invention include a laundry composition having a SI greater than 3.

If the dosage of the compositions vary from sample to sample, then it may be desirable to normalize the SI results for comparison across a large sample set of various compositions. In various embodiments, the SI can be normalized by including the weight or the volume of a dosage of a composition. For example, a normalized SI ($SI_N$) can be described by the following equation:

$$SI_N = \frac{\dfrac{(\%\ \text{cleaning efficiency})}{(\text{dosage amount})}}{\dfrac{(\%\ \text{total carbon footprint})}{(\text{dosage amount})}}$$

Various embodiments of the present invention include a laundry composition having a $SI_N$ greater than 3.

In various embodiments of the present invention, SI can also take into consideration the percentage of renewable carbon content in the composition. In this regard, renewable carbon content can include any carbon content that originates in a renewable resource such as for example a tree. Such components for example, coconut oil, palm oil, aloe, a naturally derived essence, and the like come from renewable resources. In various embodiments of the present invention, a laundry cleaning composition has said $SI_{RN}$ greater than 6 by the following formula:

$$SI_{RN} = \frac{(\%\ \text{cleaning efficiency})}{(\%\ \text{total carbon footprint}) - (\%\ \text{renewable carbon})}.$$

The renewable carbon can be calculated in by a variety of methods. For example, renewable materials typically originate from plants, animals, and/or microorganisms. One method of calculating the % renewable carbon can be a calculation of the weight renewable ingredients divided by the total weight of the composition and multiplied by 100 to create the percentage of renewable carbon. Another method of calculating the % renewable carbon can be a calculation of weight of petroleum based ingredients plus the weight of ore based ingredients and subtracting this total from the total weight of the composition; the resulting difference is then divided by the total weight of the composition and multiplied by 100 to create the percentage of renewable carbon. Some method may only perform a calculation of % renewable carbon by using only the organic portion of a composition since the non-organic portion may be considered neutral as far as a carbon footprint. Of course those skilled in the art may be aware of a multitude of methods for calculating a percentage of renewable carbon and any of these methods may be used as long as the same methodology is used across the array of compositions that are being compared or evaluated.

In addition, could be modified to include other factors described in FIG. 1 and FIG. 2, such as for example, a factor for renewable products and/or a factor for biodegradability. For example, the OECD 301 standard could used to create a factor for biodegradability of a laundry composition and such a factor could be included in a SI formula.

Various embodiments of the present invention include methods of formulating and producing a laundry cleaning product. Such a method comprises formulating said laundry cleaning product, determining the SI of said laundry product and producing said laundry product if the SI is at least 3. Such methods can take into renewable carbon content using $SI_{RN}$ and producing the product if $SI_{RN}$ is greater than 6.

The above being noted, various embodiments of the present invention include methods of producing an environmentally friendly cleaning composition. Such a method comprises formulating a composition and determining the (SI) of the composition and producing said composition if the SI is at least 3. In accordance with the above discussion, such methods can also take into renewable carbon content using $SI_{RN}$ and producing the product if $SI_{RN}$ is greater than 6.

Various embodiments include methods of formulating and producing a detergent. Such methods can comprise selecting at least one anionic surfactant, selecting at least one enzyme, selecting at least inorganic salt, selecting at least one acid, combining said at least one anionic surfactant, at least one enzyme, at least inorganic salt, at least one acid and water to create a detergent, and determining a SI of the detergent, and producing the detergent if the SI is greater than 3. As discussed herein, such methods can take into renewable carbon content using $SI_{RN}$ and producing the product if $SI_{RN}$ is greater than 6.

In various embodiments, liquid laundry detergent compositions are provided that show remarkable performance even though they utilize only eco-friendly ingredients and have a sustainability index of greater than 3. Some embodiments include a liquid laundry detergent composition comprising alkyl polyglycoside (APG) with fatty alcohol sulfate, at least two detersive enzymes, an enzyme stabilization system (e.g. borate and/or citrate and/or calcium salts), d-limonene or other natural essence, water and adjuvant. In another exemplary embodiment, APG is combined with fatty acid soaps, at least two detersive enzymes, an enzyme stabilization system (e.g. borate and/or citrate and/or calcium salts), d-limonene or other natural essence, water and adjuvant. Such compositions show remarkable performance, good viscosity, physical storage stability, enzyme stability, and have a sustainability index of greater than 3.

Table 4 includes the SI of selected laundry compositions including compositions in accordance with the present invention.

TABLE 4

Sustainability Index (SI) of selected laundry compositions

| Composition | SI |
|---|---|
| New Formula 1 | 4.48 |
| New Formula 2 | 3.34 |
| Retail 2 | 2.45 |
| Retail 3 | 0.87 |
| Retail 5 | 2.30 |
| Retail 13 | 0.90 |
| Retail 14 | 2.90 |

From the results described in Table 5, New Formula 1 and New Formula 2 are the only laundry compositions that have a SI greater than 3.

The following description sets forth exemplary laundry detergent compositions according to various embodiments of the present invention.

The Nonionic Surfactant Component

The compositions of the present invention require a nonionic surfactant. Nonionic surfactants are particularly good at removing oily soils from fabrics. Nonionic surfactants useful in the present invention preferably include the alkyl polyglycoside surfactants. The alkyl polyglycosides (APGs), also called alkyl polyglucosides if the saccharide moiety is glucose, are naturally derived, nonionic surfactants.

The alkyl polyglycosides that are preferred for use in the present invention are fatty ester derivatives of saccharides or polysaccharides that are formed when a carbohydrate is reacted under acidic condition with a fatty alcohol through condensation polymerization. The APGs are typically derived from corn-based carbohydrates and fatty alcohols from natural oils in animals, coconuts and palm kernels. Such methods for deriving APGs are well known in the art, for example U.S. Pat. Nos. 5,003,057 and 5,003,057 relating to the methods of making APGs and the chemical properties of APGs The alkyl polyglycosides that are preferred for use in the present invention contain a hydrophilic group derived from carbohydrates and is composed of one or more anhydroglucose units. Each of the glucose units can have two ether oxygen atoms and three hydroxyl groups, along with a terminal hydroxyl group, which together impart water solubility to the glycoside. The presence of the alkyl carbon chain leads to the hydrophobic tail to the molecule.

When carbohydrate molecules react with fatty alcohol compounds, alkyl polyglycoside molecules are formed having single or multiple anhydroglucose units, which are termed monoglycosides and polyglycosides, respectively. The final alkyl polyglycoside product typically has a distribution of varying concentration of glucose units (or degree of polymerization).

The APGs that may be used in the detergent composition of the invention preferably comprise saccharide or polysaccharide groups (i.e., mono-, di-, tri-, etc. saccharides) of hexose or pentose, and a fatty aliphatic group having 6 to 20 carbon atoms. Preferred alkyl polyglycosides that can be used according to the present invention are represented by the general formula, $G_x$-O—$R^1$, wherein G is a moiety derived from reducing saccharide containing 5 or 6 carbon atoms, e.g., pentose or hexose; $R^1$ is fatty alkyl group containing 6 to 20 carbon atoms; and x is the degree of polymerization of the polyglycoside, representing the number of monosaccharide repeating units in the polyglycoside. Generally, x is an integer on the basis of individual molecules, but because there are statistical variations in the manufacturing process for APGs, x may be a noninteger on an average basis when referred to APG used as an ingredient for the detergent composition of the present invention. For the APGs of use in the compositions of the present invention, x preferably has a value of less than 2.5, and more preferably is between 1 and 2. Exemplary saccharides from which G can be derived are glucose, fructose, mannose, galactose, talose, gulose, allose, altrose, idose, arabinose, xylose, lyxose and ribose. Because of the ready availability of glucose, glucose is preferred in polyglycosides. The fatty alkyl group is preferably saturated, although unsaturated fatty chains may be used. Generally, the commercially available polyglycosides have $C_8$ to $C_{16}$ alkyl chains and an average degree of polymerization of from 1.4 to 1.6.

Commercially available alkyl polyglycoside can be obtained as concentrated aqueous solutions ranging from 50 to 70% actives and are available from Cognis. Most preferred for use in the present compositions are APGs with an average degree of polymerization of from 1.4 to 1.7 and the chain lengths of the aliphatic groups are between $C_8$ and $C_{16}$. For example, one preferred APG for use herein has chain length of $C_8$ and $C_{10}$ (ratio of 45:55) and a degree of polymerization of 1.7. The detergent compositions of the present invention have the advantage of having less adverse impact on the environment than conventional detergent compositions. Alkyl polyglycosides used in the present invention exhibit low oral and dermal toxicity and irritation on mammalian tissues. These alkyl polyglycosides are also biodegradable in both anaerobic and aerobic conditions and they exhibit low toxicity to plants, thus improving the environmental compatibility of the rinse aid of the present invention. Because of the carbohydrate property and the excellent water solubility characteristics, alkyl polyglycosides are compatible in high caustic and builder formulations. The detergent composition preferably includes a sufficient amount of alkyl polyglycoside surfactant in an amount that provides a desired level of cleaning on fabrics. The preferred level of alkyl polyglycoside in the present invention is from about 1% to about 50%. Most preferred is from about 3% to about 40%.

In addition to the APG nonionic surfactants, the compositions of the present invention may also contain ethoxylated primary alcohols represented by the general formula R—$(OCH_2CH_2)_X$—OH, where R is $C_{10}$ to $C_{18}$ carbon atoms preferably from natural, non-petroleum sources, and x is on average from 4 to 12 mol of ethylene oxide (EO). Further examples are alcohol ethoxylates containing linear radicals from alcohols of natural origin having 12 to 18 carbon atoms, e.g., from coconut, palm, tallow fatty or oleyl alcohol and on average from 4 to about 12 EO per mole of alcohol. Most useful as a nonionic surfactant in the present invention is the $C_{12}$-$C_{14}$ alcohol ethoxylate-7EO, and the $C_{12}$-$C_{14}$ alcohol ethoxylate-12EO incorporated in the composition at from about 1% to about 50%. Preferred nonionic surfactants for use in this invention include for example, Neodol® 45-7, Neodol® 25-9, or Neodol® 25-12 from Shell Chemical Company and most preferred are Surfonic® L24-7, which is a $C_{12}$-$C_{14}$ alcohol ethoxylate-7EO, and Surfonic® L24-12, which is a $C_{12}$-$C_{14}$ alcohol ethoxylate-12EO, both available from Huntsman. Combinations of more than one alcohol ethoxylate surfactant may also be desired in the detergent composition in order to maximize cleaning performance in the washing machine. The preferred level of alcohol ethoxylate in the present invention is from about 1% to about 50%. Most preferred is from about 3% to about 40%.

The Anionic Surfactant Component

The compositions of the present invention includes an anionic surfactant. Most preferably, the detergent compositions contain alkyl sulfates, also known as alcohol sulfates. These surfactants have the general formula R—O—$SO_3$Na where R is from about 10 to 18 carbon atoms, and these materials may also be denoted as sulfuric monoesters of $C_{10}$-$C_{18}$ alcohols, examples being sodium decyl sulfate, sodium palmityl alkyl sulfate, sodium myristyl alkyl sulfate, sodium dodecyl sulfate, sodium tallow alkyl sulfate, sodium coconut alkyl sulfate, and mixtures of these surfactants, or of $C_{10}$-$C_{20}$ oxo alcohols, and those monoesters of secondary alcohols of this chain length. Also useful are the alk(en)yl sulfates of said chain length which contain a synthetic straight-chain alkyl radical prepared on a petrochemical basis, these sulfates possessing degradation properties similar to those of the corresponding compounds based on fatty-chemical raw materials. From a detergents standpoint, $C_{12}$-$C_{16}$-alkyl sulfates and $C_{12}$-$C_{15}$-alkyl sulfates, and also $C_{14}$-$C_{15}$ alkyl sulfates, are preferred. In keeping with the utilization of only natural feedstock, the fatty alcohol portion of the surfactant is preferably animal or vegetable derived, rather than petroleum derived. Therefore the fatty alcohol portion of the surfactant will comprise distributions of even number carbon chains, e.g. $C_{12}$, $C_{14}$, $C_{16}$, $C_{18}$, and so forth. Also of use are 2,3-alkyl sulfates, which are obtainable from Shell Oil Company under the brand name DAN®. Most preferred is to use sodium lauryl sulfate from the Stepan Company under the trade name of Polystep® or the Standapol® brand available from Cognis. The preferred level of alcohol sulfate in the present invention is from about 1% to about 50%. Most preferred is from about 3% to about 40%.

Optionally, the compositions may include fatty acid soaps as an anionic surfactant ingredient component. The fatty acids that may find use in the present invention may be represented by the general formula R—COOH, wherein R represents a linear or branched alkyl or alkenyl group having between about 8 and 24 carbons. It is understood that within the compositions of the present invention, the free fatty acid form (the carboxylic acid) may be utilized and converted to the carboxylate salt in-situ (that is, to the fatty acid soap), by excess alkalinity present in the composition from added alkaline builder. As used herein, "soap" means salts of fatty acids. Thus, after mixing and obtaining the compositions of the present invention, the fatty acids may be present in the composition as R—COOM, wherein R represents a linear or branched alkyl or alkenyl group having between about 8 and 24 carbons and M represents an alkali metal such as sodium or potassium. The fatty acid soap, which is often a desirable component having suds reducing effect in the washer, (and especially advantageous for side loading or horizontal tub laundry machines), is preferably comprised of higher fatty acid soaps. The fatty acids that are added directly into the compositions of the present invention may be derived from natural fats and oils, such as those from animal fats and greases and/or from vegetable and seed oils, for example, tallow, hydrogenated tallow, whale oil, fish oil, grease, lard, coconut oil, palm oil, palm kernel oil, olive oil, peanut oil, corn oil, sesame oil, rice bran oil, cottonseed oil, babassu oil, soybean oil, castor oil, and mixtures thereof. Although fatty acids can be synthetically prepared, for example, by the oxidation of petroleum, or by hydrogenation of carbon monoxide by the Fischer-Tropsch process, the naturally obtainable fats and oils are preferred. The fatty acids of particular use in the present invention are linear or branched and containing from about 8 to about 24 carbon atoms, preferably from about 10 to about 20 carbon atoms and most preferably from about 14 to about 18 carbon atoms. Preferred fatty acids for use in the present invention are tallow or hydrogenated tallow fatty acids. Preferred salts of the fatty acids are alkali metal salts, such as sodium and potassium or mixtures thereof and, as mentioned above, preferably the soaps generated in-situ by neutralization of the fatty acids with excess alkali from added alkaline materials. Other useful soaps are ammonium and alkanol ammonium salts of fatty acids, with the understanding that these soaps may also be added to the compositions as the pre-formed ammonium, alkylammonium or alkanolammonium salts or neutralized in-situ within added alkaline materials such as ammonia, alkylamine or one of the alkanolamine species (e.g. MEA, DEA, TEA, etc.). The fatty acids that may be included in the present compositions will preferably be chosen to have desirable detergency and suds modulating effect. Fatty acid soaps may be incorporated in the compositions of the present invention at from about 1% to about 10%.

The ecologically responsible detergent compositions of the present invention may also include the alkyl ether sulfates, also known as alcohol ether sulfates, as an anionic surfactant component. Alcohol ether sulfates are the sulfuric monoesters of the straight chain or branched alcohol ethoxylates and have the general formula R—$(OCH_2CH_2)_x$—O—$SO_3M$, where R preferably comprises $C_7$-$C_{21}$ alcohol ethoxylated with from about 0.5 to about 9 mol of ethylene oxide (i.e., x=0.5 to 9 EO), such as $C_{12}$-$C_{18}$ alcohols containing from 0.5 to 9 EO, and where M is alkali metal or ammonium, alkyl ammonium or alkanol ammonium counterion. Preferred alkyl ether sulfates for use in one embodiment of the present invention are $C_8$-$C_{18}$ alcohol ether sulfates with a degree of ethoxylation of from about 0.5 to about 9 ethylene oxide moieties and most preferred are the $C_{12}$-$C_{15}$ alcohol ether sulfates with ethoxylation from about 4 to about 9 ethylene oxide moieties, with 7 ethylene oxide moieties being most preferred. In keeping with the utilization of only natural feedstock for ingredients used in an eco-friendly detergent, the fatty alcohol portion of the surfactant is preferably animal or vegetable derived, rather than petroleum derived. Therefore the fatty alcohol portion of the surfactant will comprise distributions of even number carbon chains, e.g. $C_{12}$, $C_{14}$, $C_{16}$, $C_{18}$, and so forth. It is understood that when referring to alkyl ether sulfates, these substances are already salts (hence "sulfonate"), and most preferred and most readily available are the sodium alkyl ether sulfates (also referred to as NaAES). Commercially available alkyl ether sulfates include the CALFOAM® alcohol ether sulfates from Pilot Chemical, the EMAL®, LEVENOL® and LATEMAL® products from Kao Corporation, and the POLYSTEP® products from Stepan, most of these with fairly low EO content (e.g., average 3 or 4-EO). Alternatively the alkyl ether sulfates for use in the present invention may be prepared by sulfonation of alcohol ethoxylates (i.e., nonionic surfactants) if the commercial alkyl ether sulfate with the desired chain lengths and EO content are not easily found, but perhaps where the nonionic alcohol ethoxylate starting material may be. For example, sodium lauryl ether sulfate ("sodium laureth sulfate", having about 2-3 ethylene oxide moieties) is very readily available commercially and quite common in shampoos and detergents. Sodium lauryl ether sulfate is preferred for use in the detergents of the present invention. Depending on the degree of ethoxylation desired, it may be more practical to sulfonate a commercially available nonionic surfactant such as Neodol® 25-7 Primary Alcohol Ethoxylate (a $C_{12}$-$C_{15}$/7EO nonionic from Shell) to obtain for example the $C_{12}$-$C_{15}$/7EO alkyl ether sulfate that may have been more difficult to source commercially. The preferred level of $C_{12}$-$C_{18}$/0.5-9EO alkyl ether sulfate in the present invention is from about 1% to about 50%. Most preferred is to incorporate sodium lauryl ether sulfate (e.g. Calfoam® ES-302) from about 3% to about 40% actives weight basis.

Other anionic surfactants that may find use in the compositions of the present invention include the alpha-sulfonated alkyl esters of $C_{12}$-$C_{16}$ fatty acids. The alpha-sulfonated alkyl esters may be pure alkyl ester or a blend of (1) a mono-salt of an alpha-sulfonated alkyl ester of a fatty acid having from 8-20 carbon atoms where the alkyl portion forming the ester is straight or branched chain alkyl of 1-6 carbon atoms and (2) a di-salt of an alpha-sulfonated fatty acid, the ratio of mono-salt to di-salt being at least about 2:1. The alpha-sulfonated alkyl esters useful herein are typically prepared by sulfonating an alkyl ester of a fatty acid with a sulfonating agent such as $SO_3$. When prepared in this manner, the alpha-sulfonated alkyl esters normally contain a minor amount, (typically less than 33% by weight), of the di-salt of the alpha-sulfonated fatty acid which results from saponification of the ester. Preferred alpha-sulfonated alkyl esters contain less than about 10% by weight of the di-salt of the corresponding alpha-sulfonated fatty acid.

The alpha-sulfonated alkyl esters, i.e., alkyl ester sulfonate surfactants, include linear esters of $C_8$-$C_{20}$ carboxylic acids that are sulfonated with gaseous $SO_3$ as described in the "The Journal of American Oil Chemists Society," 52 (1975), pp. 323-329. Suitable starting materials preferably include natural fatty substances as derived from tallow, palm oil, etc., rather than petroleum derived materials. The preferred alkyl ester sulfonate surfactants, especially for laundry detergent compositions of the present invention, comprise alkyl ester sulfonate surfactants of the structural formula $R^3$—CH$(SO_3M)$-$CO_2R^4$, wherein $R^3$ is a $C_8$-$C_{20}$ hydrocarbon chain preferably naturally derived, $R^4$ is a straight or branched chain $C_1$-$C_6$ alkyl group and M is a cation which forms a water soluble salt with the alkyl ester sulfonate, including sodium, potassium, magnesium, and ammonium cations. Preferably, $R^3$ is $C_{10}$-$C_{16}$ fatty alkyl, and $R^4$ is methyl or ethyl. Most preferred are alpha-sulfonated methyl or ethyl esters of a distribution of fatty acids having an average of from 12 to 16 carbon atoms. For example, the alpha-sulfonated esters; Alpha-Step® BBS-45, Alpha-Step® MC-48, and Alpha-Step® PC-48, all available from the Stepan Co. of Northfield, Ill., may find use in the present invention. However, the methyl esters are derived from methanol sources. Thus, the ethyl esters, which are currently not commercially available, would be the most preferred alpha-sulfonated fatty acid esters.

The Detersive Enzymes Component

The compositions of the present invention also include two or more detersive enzymes, in any combination. Enzymes are included in the present detergent compositions for a variety of purposes, including removal of protein-based, carbohydrate-based, or triglyceride-based stains from substrates. Generally, suitable enzymes include cellulases, hemicellulases, proteases, gluco-amylases, amylases, lipases, cutinases, pectinases, xylanases, keratinases, reductases, oxidases, phenoloxidases, lipoxygenases, ligninases, pullulanases, tannases, chondriotinases, thermitases, pentosanases, malanases, β-glucanases, arabinosidases or mixtures thereof of any suitable origin, such as vegetable, animal, bacterial, fungal and yeast origin. Preferred enzymes for use in the present invention are dictated by factors such as formula pH, thermostability, and stability to surfactants chosen. In this regard, bacterial or fungal enzymes are preferred, such as bacterial amylases and proteases, and fungal cellulases. A preferred combination is a detergent composition having a mixture of conventional detergent enzymes like protease, amylase, lipase, cutinase and/or cellulose, in a number of combinations. Suitable enzymes are also described in U.S. Pat. Nos. 5,677,272, 5,679,630, 5,703,027, 5,703,034, 5,705,464, 5,707,950, 5,707,951, 5,710,115, 5,710,116, 5,710,118, 5,710,119 and 5,721,202. The compositions of the present invention will preferably contain from about 0.0001% to about 5% by weight of the composition of enzyme.

"Detersive enzyme", as used herein, means any enzyme having a cleaning, stain removing or otherwise beneficial effect in a detergent compositions. Preferred detersive enzymes include hydrolases such as proteases, amylases and lipases. Highly preferred are amylases and/or proteases, including both current commercially available types and the "improved" types. Enzymes are normally incorporated into detergent compositions at levels sufficient to provide a "cleaning-effective amount". The term "cleaning effective amount" refers to any amount capable of producing a cleaning, stain removal, soil removal, whitening, deodorizing, or freshness improving effect on fabrics. Typical amounts utilized are up to about 5 mg by weight, more typically 0.01 mg to 3 mg, of active enzyme per gram of the detergent composition. The compositions herein may comprise in total from 0.001% to 5%, and preferably 0.01%-1% by weight of at least two detersive enzymes. Protease enzymes are usually present at levels sufficient to provide from 0.005 to 0.1 Anson units (AU) of activity per gram of composition. For certain detergents it may be desirable to increase the active enzyme content in order to minimize the total amount of detersive ingredients in the composition, although there is a balance of cost to consider. Higher active levels may also be desirable in highly concentrated detergent formulations. Proteolytic enzymes can be of animal, vegetable or microorganism origin, with the latter preferred. The proteases for use in the detergent compositions herein include, but are not limited to, trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*. Suitable proteolytic enzymes include Novo Alcalase®, Esperase®, Savinase®, Gist-brocades' Maxatase®, Maxacal® and Maxapem 15® (protein engineered Maxacal®), and subtilisin BPN and BPN', which are all commercially available. Preferred proteolytic enzymes also include modified bacterial serine proteases, such as those made by Genencor, e.g. as described in European Patent 251,446B. U.S. Pat. No. 5,030,378 to Venegas refers to a modified bacterial serine proteolytic enzyme (Genencor International), which is called "Protease A". Other proteases that may find use in the present compositions are sold under the tradenames: Primase®, Durazym®, Opticlean® and Optimase® and Alcalase®.

Amylases (α and/or β) can be included as one of the two detersive enzymes in the present composition for removal of carbohydrate-based stains. Suitable amylases are Termamyl®, Fungamyl®, BAN®, and Stainzyme®. The enzymes may be of any suitable origin, such as vegetable, animal, bacterial, fungal and yeast origin. The composition will preferably contain at least from about 0.0001% to about 2% by weight of the composition of amylase enzyme. Amylase enzymes also include those described in WO95/26397. Other amylases suitable herein include, for example, α-amylases RAPIDASE®, from International Bio-Synthetics, Inc., TERMAMYL®, from Novo, and FUNGAMYL® from Novo. Engineering of enzymes for improved stability, e.g., oxidative stability, is known. Stability-enhanced amylases can be obtained from Novo or from Genencor International.

Cellulases usable herein include both bacterial and fungal types. U.S. Pat. No. 4,435,307, issued to Barbesgoard et al, discloses suitable fungal cellulases from *Humicola insolens* or *Humicola* strain DSM1800 or a cellulase 212-producing fungus belonging to the genus *Aeromonas*, and cellulase extracted from the hepatopancreas of a marine mollusk, Dolabella Auricula Solander. Suitable cellulases include CAREZYME® and CELLUZYME® (from Novo).

Lipase enzymes include those produced by microorganisms of the *Pseudomonas* group, such as *Pseudomonas stutzeri* ATCC 19.154. Suitable lipases include those that show a positive immunological cross-reaction with the antibody of the lipase, produced by the microorganism *Pseudomonas fluorescens* IAM 1057. This lipase is available from Amano Pharmaceutical Co. Ltd., Nagoya, Japan, under the trade name Lipase P "Amano," hereinafter referred to as "Amano-P". Further suitable lipases are lipases such as Lipex®, M1 Lipase® and Lipomax®. Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., and lipases ex *Pseudomonas* gladioli. LIPOLASE® enzyme derived from *Humicola lanuginosa* and commercially available from Novo is also a preferred lipase for use herein, along with Lipolase Ultra®. Lipase and amylase variants stabilized against peroxidase enzymes are described in WO9414951A to Novo.

Various carbohydrase enzymes which impart antimicrobial activity may also be included in the present invention. Such enzymes include endoglycosidase, Type II endoglycosidase and glucosidase as disclosed in U.S. Pat. Nos. 5,041,236, 5,395,541, 5,238,843 and 5,356,803. Of course, other enzymes having antimicrobial activity may be employed as well including peroxidases, oxidases and various other enzymes.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas.

The Natural Essence Component

In addition to anionic and nonionic surfactants and the detersive enzyme components, the liquid laundry detergents compositions of the present invention include a "natural essence". As referred to for purposes of this invention, "natural essence" is intended to include a broader class of natural products comprising natural oils extracted from plants and trees and their fruits, nuts and seeds, (for example by steam or liquid extraction of ground-up plant/tree material), natural products that may be purified by distillation, (i.e., purified single organic molecules or close boiling point "cuts" of organic materials such as terpenes and the like), and synthetic organic materials that are the synthetic versions of natural materials (e.g., either identical to the natural material or perhaps the optical isomer, or the racemic mixture). An example of the latter is d,l-limonene that is synthetically prepared and is a good and eco-friendly substitute for natural orange oil (mostly d-limonene) when crop yields are expensive due to citrus crop freezes. Thus, it should be understood that "natural essence" incorporates a wide range of pure organic materials either natural or synthetic, mixtures of these previously purified individual materials or distillate cuts of materials, and complex natural mixtures directly extracted from plant/tree materials through infusion, steam extraction, etc. Also, it should be understood that these natural essence ingredients may double as fragrance materials for the detergent composition, and in fact many natural extracts, oils, essences, infusions and such are very fragrant materials. However, for use in the present compositions, these materials are used at higher levels than would be typical for fragrance purposes, and it should be also understood that depending on optical isomers used, there may be no smell or a reduced smell, or even a masking effect to the human sensory perception. Thus by judicious choice of natural essence mixtures, performance boosting may be effected without making the compositions overwhelmingly scented. Also, actual fragrance masking materials (such as used for household cleaners and available from the fragrance supply houses such as IFF, Symrise, Givaudan, Firmenich, and others) may be added to mask the smells of the natural essences.

Some of the naturally derived essences for use in the present compositions include, but are not limited to, musk, civet, ambergis, castoreum and similar animal derived oils; abies oil, ajowan oil, almond oil, ambrette seed absolute, angelic root oil, anise oil, basil oil, bay oil, benzoin resinoid, bergamot oil, birch oil, bois de rose oil, broom abs., cajeput oil, cananga oil, capsicum oil, caraway oil, cardamon oil, carrot seed oil, cassia oil, cedar leaf oil, cedar wood oil, celery seed oil, cinnamon bark oil, citronella oil, clary sage oil, clove oil, cognac oil, coriander oil, cubeb oil, cumin oil, camphor oil, dill oil, elemi gum, estragon oil, eucalyptol nat., eucalyptus oil, fennel sweet oil, galbanum res., garlic oil, geranium oil, ginger oil, grapefruit oil, hop oil, hyacinth abs., jasmin abs., juniper berry oil, labdanum res., lavender oil, laurel leaf oil, lavender oil, lemon oil, lemongrass oil, lime oil, lovage oil, mace oil, mandarin oil, mimosa abs., myrrh abs., mustard oil, narcissus abs., neroli bigarade oil, nutmeg oil, oakmoss abs., olibanum res., onion oil, opoponax res., orange oil, orange flower oil, origanum, orris concrete, pepper oil, peppermint oil, peru balsam, petitgrain oil, pine needle oil, rose abs., rose oil, rosemary oil, safe officinalis oil, sandalwood oil, sage oil, spearmint oil, styrax oil, thyme oil, tolu balsam, tonka beans abs., tuberose abs., turpentine oil, vanilla beans abs., vetiver oil, violet leaf abs., ylang ylang oil and similar vegetable oils, etc.

Synthetic essences include but are not limited to pinene, limonene and like hydrocarbons; 3,3,5-trimethylcyclohexanol, linalool, geraniol, nerol, citronellol, menthol, borneol, borneyl methoxy cyclohexanol, benzyl alcohol, anise alcohol, cinnamyl alcohol, β-phenyl ethyl alcohol, cis-3-hexenol, terpineol and like alcohols; anethole, musk xylol, isoeugenol, methyl eugenol and like phenols; α-amylcinnamic aldehyde, anisaldehyde, n-butyl aldehyde, cumin aldehyde, cyclamen aldehyde, decanal, isobutyl aldehyde, hexyl aldehyde, heptyl aldehyde, n-nonyl aldehyde, nonadienol, citral, citronellal, hydroxycitronellal, benzaldehyde, methyl nonyl acetaldehyde, cinnamic aldehyde, dodecanol, α-hyxylcinnamic aldehyde, undecenal, heliotropin, vanillin, ethyl vanillin and like aldehydes; methyl amyl ketone, methyl β-naphthyl ketone, methyl nonyl ketone, musk ketone, diacetyl, acetyl propionyl, acetyl butyryl, carvone, menthone, camphor, acetophenone, p-methyl acetophenone, ionone, methyl ionone and like ketones; amyl butyrolactone, diphenyl oxide, methyl phenyl glycidate, gamma-nonyl lactone, coumarin, cineole, ethyl methyl phenyl glicydate and like lactones or oxides; methyl formate, isopropyl formate, linalyl formate, ethyl acetate, octyl acetate, methyl acetate, benzyl acetate, cinnamyl acetate, butyl propionate, isoamyl acetate, isopropyl isobutyrate, geranyl isovalerate, allyl capronate, butyl heptylate, octyl caprylate octyl, methyl heptynecarboxylate, methine octynecarboxylate, isoacyl caprylate, methyl laurate, ethyl myristate, methyl myristate, ethyl benzoate, benzyl benzoate, methylcarbinylphenyl acetate, isobutyl phenylacetate, methyl cinnamate, cinnamyl cinnamate, methyl salicylate, ethyl anisate, methyl anthranilate, ethyl pyruvate, ethyl α-butyl butylate, benzyl propionate, butyl acetate, butyl butyrate, p-tert-butylcyclohexyl acetate, cedryl acetate, citronellyl acetate, citronellyl formate, p-cresyl acetate, ethyl butyrate, ethyl caproate, ethyl cinnamate, ethyl phenylacetate, ethylene brassylate, geranyl acetate, geranyl formate, isoamyl salicylate, isoamyl isovalerate, isobornyl acetate, linalyl acetate, methyl anthranilate, methyl dihydrojasmonate, nopyl acetate, β-phenylethyl acetate, trichloromethylphenyl carbinyl acetate, terpinyl acetate, vetiveryl acetate and the like.

Suitable essence mixtures may produce synergistic performance attributes for the detergent composition and may help to impart an overall fragrance perception as well to the composition including but not limited to, fruity, musk, floral, herbaceous (including mint), and woody, or perceptions that are in-between (fruity-floral for example). Typically these essence or essential oil mixtures may be compounded by mixing a variety of these active extract or synthetic materials along with various solvents to adjust cost, viscosity, flammability, ease of handling, etc. Since many natural extract ingredients are compounded into fragrances, the essential oils, infusions, distillates, etc. that are considered "natural essences" within this invention are also available from the fragrance companies such as International Flavors & Fragrances (IFF), Givaudan, Symrise, Firmenich, Robertet, and many others. The natural essences for use in the present invention are preferably incorporated at a level of from about 0.01% to about 10% as the 100% neat substance or mixture of substances.

The Enzyme Stabilization System

It also may be necessary to include an enzyme stabilization system into the compositions of the present invention when any enzyme combination is present in the composition. The compositions herein may optionally comprise from about 0.001% to about 10%, preferably from about 0.005% to about 8%, most preferably from about 0.01% to about 6%, by weight of an enzyme stabilizing system, when the composition also contains an enzyme. The enzyme stabilizing system can be any stabilizing system which is compatible with the protease or other enzymes used in the compositions herein. Such stabilizing systems can comprise calcium ion, boric acid, propylene glycol, short chain carboxylic acid, boronic acid, polyhydroxyl compounds and mixtures thereof such as are described in U.S. Pat. No. 4,261,868, Hora et al, issued Apr. 14, 1981; U.S. Pat. No. 4,404,115, Tai, issued Sep. 13, 1983; U.S. Pat. No. 4,318,818, Letton et al; U.S. Pat. No. 4,243,543, Guildert et al issued Jan. 6, 1981; U.S. Pat. No. 4,462,922, Boskamp, issued Jul. 31, 1984; U.S. Pat. No. 4,532,064, Boskamp, issued Jul. 30, 1985; and U.S. Pat. No. 4,537,707, Severson Jr., issued Aug. 27, 1985.

The composition will preferably contain at least about 0.001%, more preferably at least about 0.005%, even more preferably still, at least about 0.01% by weight of the composition of enzyme stabilizing system. The composition will also preferably contain no more than about 10%, more preferably no more than about 8%, no more than about 6% of active enzyme by weight of the composition of enzyme stabilizing system.

Optional Components

The liquid laundry detergent compositions of the present invention may also include one or more builders. Builders are well known in the laundry detergent art and include such species as hydroxides, carbonates, sesquicarbonates, bicarbonates, borates, citrates, silicates, zeolites, and such. Preferred builders for use in the present invention include but are not limited to sodium hydroxide (NaOH), potassium hydroxide (KOH), magnesium hydroxide ($Mg(OH)_2$), sodium carbonate ($Na_2CO_3$), potassium carbonate ($K_2CO_3$), sodium bicarbonate ($NaHCO_3$), potassium bicarbonate ($KHCO_3$), sodium sesquicarbonate ($Na_2CO_3.NaHCO_3.2H_2O$), sodium silicate ($SiO_2/Na_2O$), sodium borate ($Na_2B_4O_7$—$(H_2O)_{10}$ or "borax"), citric acid ($C_6H_8O_7$), monosodium citrate ($NaC_6H_7O_7$), disodium citrate ($Na_2C_6H_6O_7$), and trisodium citrate ($Na_3C_6H_5O_7$), and mixtures thereof. It should be understood that combinations of free acid materials (like citric acid) when combined with alkali such as sodium hydroxide can generate the mono-, di-, or trisodium salts of citric acid in situ. The preferred level of builder for use in these laundry detergents is from about 0.1% to about 10% by weight.

The compositions of the present invention may also include soil dispersing and/or anti-redeposition or water conditioning polymers such as sodium polyacrylate or carboxylmethylcellulose (CMC). Particularly suitable polymeric polycarboxylates are derived from acrylic acid, and this polymer and the corresponding neutralized forms include and are commonly referred to as polyacrylic acid, 2-propenoic acid homopolymer or acrylic acid polymer, and sodium polyacrylate, 2-propenoic acid homopolymer sodium salt, acrylic acid polymer sodium salt, poly sodium acrylate, or polyacrylic acid sodium salt. Preferred in the compositions of the present invention is sodium polyacrylate with average molecular weight from about 2,000 to 10,000, more preferably from about 4,000 to 7,000 and most preferably from about 4,000 to 5,000. Soluble polymers of this type are known materials, for example the sodium polyacrylates and polyacrylic acids from Rohm and Haas marketed under the trade name Acusol®. Of particular use in the present invention is the average 4500 molecular weight sodium polyacrylate, (for example, Acusol® 425, Acusol® 430, Acusol® 445 and Acusol® 445ND, and mixtures of these), and carboxymethylcellulose, either or a combination of the two at a preferred level of from about 0.1% to about 3%.

The detergent compositions of the present invention may also include one or more electrolytes to adjust viscosity. For example, preferred electrolytes include but are not limited to sodium chloride, sodium sulfate, calcium chloride, and borax (sodium tetraborate-decahydrate), and combinations thereof. When incorporated at a level of from about 0.1% to about 5%, large changes in viscosity may be made, and ordinarily "water-thin" liquids can be made to appear much more premium.

Optional ingredients for use in the present detergent compositions may also include peroxide and active oxygen ("peroxygen") organic and inorganic compounds to assist in the non-chlorine bleaching of bleachable stains. Such bleaching materials may include, but are not limited to hydrogen peroxide, sodium percarbonate and sodium perborate, or mixtures thereof.

Additional optional materials for use in the present detergents may include chelants such as tetrasodium ethylenediamine tetraacetate-EDTA, zeolite, NTA and it's corresponding salts, optical brighteners, dye fixatives, perfumes, additional fragrance and fragrance masking agents, odor neutralizers, dyes, pigments and colorants, solvents, cationic surfactants, other softening or antistatic agents, thickeners, emulsifiers, bleach catalysts, enzyme stabilizers, clays, surface modifying polymers, pH-buffering agents, abrasives, preservatives and sanitizers or disinfectants, anti-redeposition agents, opacifiers, anti-foaming agents, cyclodextrin, rheology-control agents, vitamins and other skin benefit agents, nano-particles and encapsulated particles, visible plastic particles, visible beads, etc., and the like, and any combination of adjuvant.

Example Compositions and Product Performance

With the necessary and optional ingredients thus described, exemplary embodiments of the eco-friendly liquid laundry detergent compositions of the present invention, with each of the components set forth in weight percent, are shown in Table 5:

TABLE 5

Components of Formula 1 and Formula 2

| Material Name | Raw Material Acitvity, % | Formula 1 Active Weight % | Formula 2 |
|---|---|---|---|
| Water | 100 | 86.940 | 85.290 |
| Citric Acid | 100 | 2.000 | 1.000 |
| carboxy methyl cellulose | 100 | — | — |
| NaOH | 50 | 1.000 | 0.750 |
| sodium tetraborate | 100 | 1.000 | 0.500 |
| alkyl polyglucoside | 50 | 3.000 | 1.750 |
| Fatty Alcohol 2 mole Ethoxylate | 26 | | 7.750 |
| FAS - sodium lauryl sulfate | 30 | 4.700 | — |
| Coconut Fatty Acid | 100 | — | — |
| optical brightener | 30 | — | — |
| polyacylate | 45 | 0.500 | 0.400 |
| d-limonene (essential oil) | 100 | 0.250 | — |
| Fragrance | — | — | 0.300 |
| Calcium Chloride | 35 | 0.050 | 0.050 |
| Protease | 100 | 0.400 | 0.300 |
| Lipase | 100 | — | — |
| Amylase | 100 | 0.150 | — |
| Sodium Chloride | 100 | — | 1.900 |
| Preservative | 10 | 0.010 | 0.010 |
| | Total: | 100.000 | 100.000 |

TABLE 6

Stain performance of cold water wash of select laundry compositions

| Stain | New Formula 1 | New Formula 2 | Retail 4 | Retail 5 |
|---|---|---|---|---|
| Animal blood | 84.83 | 86.26 | 85.69 | 84.80 |
| Black Todd clay | 87.81 | 88.28 | 88.90 | 87.81 |
| Chocolate ice cream | 83.78 | 83.69 | 83.88 | 82.63 |
| Grass | 82.08 | 80.50 | 82.19 | 81.08 |
| Coco | 86.85 | 87.92 | 87.54 | 86.86 |
| Make up | 80.49 | 81.00 | 81.39 | 80.58 |
| Lipstick | 54.25 | 55.05 | 55.19 | 54.47 |

TABLE 6-continued

Stain performance of cold water wash of select laundry compositions

| Stain | New Formula 1 | New Formula 2 | Retail 4 | Retail 5 |
|---|---|---|---|---|
| Ground in dirt | 79.84 | 81.40 | 81.02 | 78.28 |
| Coffee | 79.76 | 80.01 | 80.08 | 80.16 |
| Tea | 81.64 | 81.41 | 81.75 | 81.55 |
| Blueberry | 74.26 | 73.09 | 73.11 | 74.71 |
| Wine | 79.96 | 80.04 | 79.77 | 78.99 |
| Tomato sauce | 88.14 | 88.13 | 88.25 | 87.86 |
| Taco grease | 55.85 | 55.83 | 57.81 | 56.18 |
| Canola oil | 62.26 | 61.73 | 62.47 | 61.91 |
| Bacon grease | 59.15 | 57.85 | 59.64 | 58.09 |
| Olive oil | 61.93 | 61.31 | 62.09 | 61.35 |
| Sheep blood | 88.06 | 88.75 | 88.52 | 88.44 |
| Blueberry juice | 57.22 | 52.95 | 55.04 | 59.39 |
| Grass | 86.04 | 84.86 | 84.63 | 84.89 |
| Spinach | 80.90 | 82.02 | 80.41 | 78.96 |
| Ketchup | 89.40 | 89.36 | 89.56 | 89.54 |
| Spaghetti sauce | 89.29 | 89.03 | 88.50 | 89.06 |
| Choc mousse (water) | 71.52 | 71.09 | 72.09 | 69.98 |
| Curry sauce | 86.57 | 86.35 | 86.76 | 86.64 |
| Balsamic vinaigrette | 79.11 | 78.79 | 78.89 | 78.77 |
| Cherry juice | 82.89 | 82.74 | 83.13 | 83.09 |
| Red wine | 82.09 | 76.01 | 75.92 | 79.62 |
| Tea | 83.17 | 83.39 | 84.00 | 84.07 |
| Cocoa | 71.63 | 73.35 | 72.54 | 71.45 |
| Chop ice cream | 78.84 | 77.94 | 80.38 | 78.72 |
| Mousse au Choc | 66.46 | 67.22 | 69.47 | 67.94 |
| Average | 77.38 | 77.11 | 77.52 | 77.12 |

TABLE 7

Comparison of stain performance of cold water wash by stain type of selected laundry compositions

| Stain type | New Formula 1 | New Formula 2 | Retail 4 | Retail 5 |
|---|---|---|---|---|
| Enzyme | 80.94 | 81.25 | 81.38 | 80.44 |
| Greasy/oil | 63.79 | 63.47 | 64.28 | 63.51 |
| Particulate | 81.32 | 82.39 | 82.28 | 80.99 |
| Bleachable | 79.42 | 78.75 | 78.79 | 79.20 |
| Average | 76.37 | 76.47 | 76.68 | 76.04 |

Figure 6:
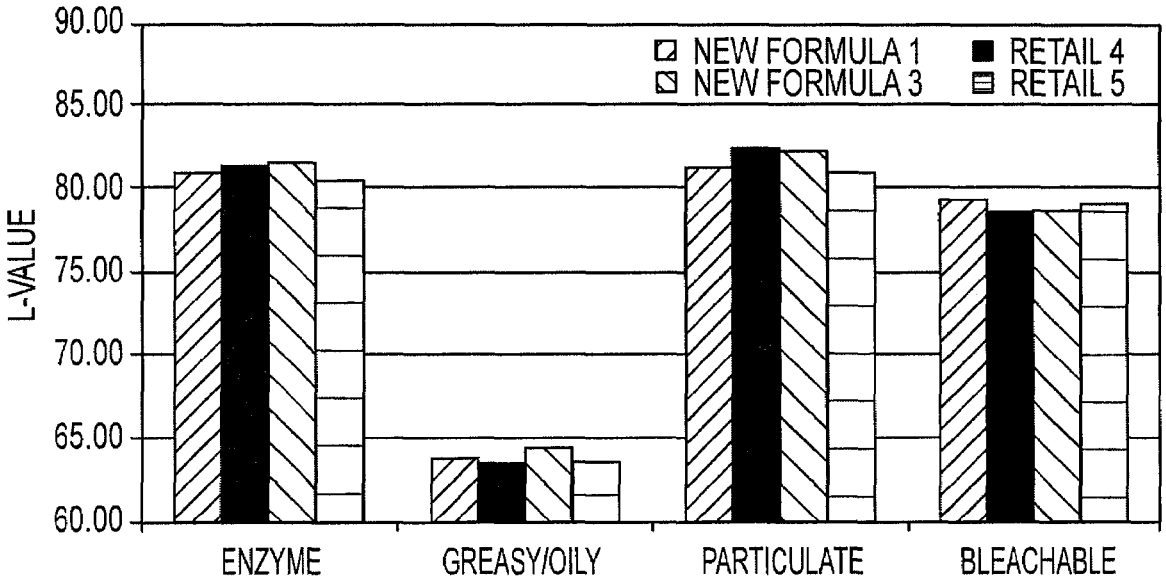
FIG. 6 is a chart illustrating a comparison by stain types and a total cleaning efficiency between a sampling of laundry detergent compositions in accordance with the present invention.

Table 7 is a summary by stain types and a total cleaning efficiency of each of the laundry compositions studied in Table 6. The data in Table 7 is illustrated by a chart in FIG. 6. The total cleaning efficiency of the all the laundry compositions evaluated in the cold water wash with out pretreatment are essentially equivalent. As discussed herein, this is a surprising and unexpected result.

We have thus described ecologically sensible detergent compositions that show parity or superiority to traditional liquid laundry detergents in efficiency but that are formulated with environmentally sensible components.

The citation of references herein does not constitute admission that those references are prior art or have relevance to the patentability of the invention disclosed herein. All references cited in the Description section of the specification are hereby incorporated by reference in their entirety for all purposes. In the event that one or more of the incorporated references, literature, and similar materials differs from or contradicts this application, including, but not limited to, defined terms, term usage, described techniques, or the like, this application controls.

Various embodiments and the examples described herein are exemplary and not intended to be limiting in describing the full scope of compositions and methods of these invention. Equivalent changes, modifications and variations of various embodiments, materials, compositions and methods can be made within the scope of the present invention, with substantially similar results.

The invention claimed is:

1. A laundry cleaning composition, the composition consisting essentially of:

a surfactant mixture consisting of an alkylpolyglucoside; a fatty alcohol sulfate, and optionally one or more of an ethoxylated alcohol, a fatty acid soap, and an alkyl ether sulfate;

at least one enzyme;

at least inorganic salt;

at least one acid; and a balance of water;

wherein the laundry cleaning composition has a sustainability index (SI) of at least 3 by the formula:

$$SI = \frac{(\%\ \text{cleaning efficiency})}{(\%\ \text{total carbon footprint})}.$$

2. The composition according to claim 1 further comprising a fabric softening component.

3. The composition according to claim 1 further comprising naturally derived fragrance component.

4. The composition according to claim 1 wherein said laundry cleaning composition has said SI of at least 6 by the following formula:

$$SI = \frac{(\%\ \text{cleaning efficiency})}{(\%\ \text{total carbon footprint}) - (\%\ \text{renewable carbon})}.$$

5. A method of formulating a detergent, the method comprising:

selecting an alkylpolyglucoside;

selecting a fatty alcohol sulfate;

selecting at least one enzyme;

selecting at least one inorganic salt;

selecting at least one acid;

formulating a combination consisting essentially of a surfactant mixture consisting of said alkylpolyglucoside, said fatty alcohol sulfate, and optionally one or more of an ethoxylated alcohol, a fatty acid soap, and an alkyl ether sulfate, said at least one enzyme, said at least inorganic salt, said at least one acid; and a balance of water;

determining a sustainability index (SI) of said combination by the following formula:

$$SI = \frac{(\%\ \text{cleaning efficiency})}{(\%\ \text{total carbon dioxide})};$$

accepting said combination as a formulation if said SI is at least 3.

6. The composition according to claim 1, wherein said alkylpolyglucoside is present in an amount of about 1% to about 50% of the total composition.

7. The composition according to claim 1, wherein said alkylpolyglucoside is present in an amount of about 1% to about 3% of the total composition.

8. The composition according to claim 1, wherein said fatty alcohol sulfate is present in an amount of about 1% to about 50% of the total composition.

9. The composition according to claim 1, wherein said at least one acid is citric acid.

10. The composition according to claim 1, wherein said at least one enzyme is a detersive enzyme.

11. A laundry cleaning composition, the composition consisting essentially of:

an alkylpolyglucoside represented by the general formula, $G_x$-O—$R^1$, wherein G is a moiety derived from reducing a saccharide containing 5 or 6 carbon atoms; $R^1$ is a non-petroleum derived fatty alkyl group containing about 6 to about 20 carbon atoms; and x is the degree of polymerization of the moiety, representing a number of monosaccharide repeating units in the moiety;

a fatty alcohol sulfate having the general formula R—O—$SO_3$Na where R is a non-petroleum derived fatty alkyl group containing about 10 to about 18 carbon atoms;

at least one enzyme;

at least inorganic salt;

at least one acid; and a balance of water;

wherein the laundry cleaning composition has a sustainability index (SI) of at least 3 by the formula:

$$SI = \frac{(\%\ \text{cleaning efficiency})}{(\%\ \text{carbon footprint})}.$$

* * * * *